United States Patent [19]

Ballestrazzi et al.

[11] 4,338,768

[45] Jul. 13, 1982

[54] AUTOMATIC MACHINE FOR SORTING ITEMS OF CORRESPONDENCE, PARTICULARLY MAGAZINES, INTO BATCHES EACH HAVING A DIFFERENT GENERAL DESTINATION

[75] Inventors: Aris Ballestrazzi; Lamberto Tassi, both of Vignola, Italy

[73] Assignee: SITMA - Societa Italiana Macchine Antomatiche S.p.A., Spilamberto, Italy

[21] Appl. No.: 140,602

[22] Filed: Apr. 15, 1980

[30] Foreign Application Priority Data

Apr. 24, 1979 [IT] Italy ..... 22144 A/79

[51] Int. Cl.[3] ..... B65B 61/26

[52] U.S. Cl. ..... 53/495; 53/54; 53/137; 53/500; 53/557; 209/3.3

[58] Field of Search ..... 209/3.3, 569, 583, 584, 209/DIG. 900; 53/495, 501, 137, 557, 550, 540, 54, 500; 414/901

[56] References Cited

U.S. PATENT DOCUMENTS 3,015,389 1/1962 Levy ..... 209/584 X
3,619,970 11/1971 Zelnick ..... 53/557 X
3,650,773 3/1972 Bush et al. ..... 53/502 X
3,815,313 6/1974 Heisler ..... 53/557 X
3,839,636 10/1974 Worrall ..... 209/584 X
4,167,476 9/1979 Jackson ..... 209/3.3

FOREIGN PATENT DOCUMENTS 1151263 7/1966 United Kingdom .

*Primary Examiner*—James F. Coan
*Attorney, Agent, or Firm*—Cushman, Darby & Cushman

[57] ABSTRACT

Labels with and without final item identification mark are put on the individual items in a label collocation station located upstream an item wrapping station followed by a film sealing and cutting station, a heating tunnel and a stacker. Reading means associated to the label collocation station read any identification marks on the labels and control feeding of recognition tabs onto the wrapped items from tab feeding means arranged between the sealing and cutting station and the heating tunnel. Tab detecting means arranged between the heating tunnel and the stacker control the stacker to terminate the formation of a batch of items when a tab on a wrapped item is detected.

11 Claims, 14 Drawing Figures

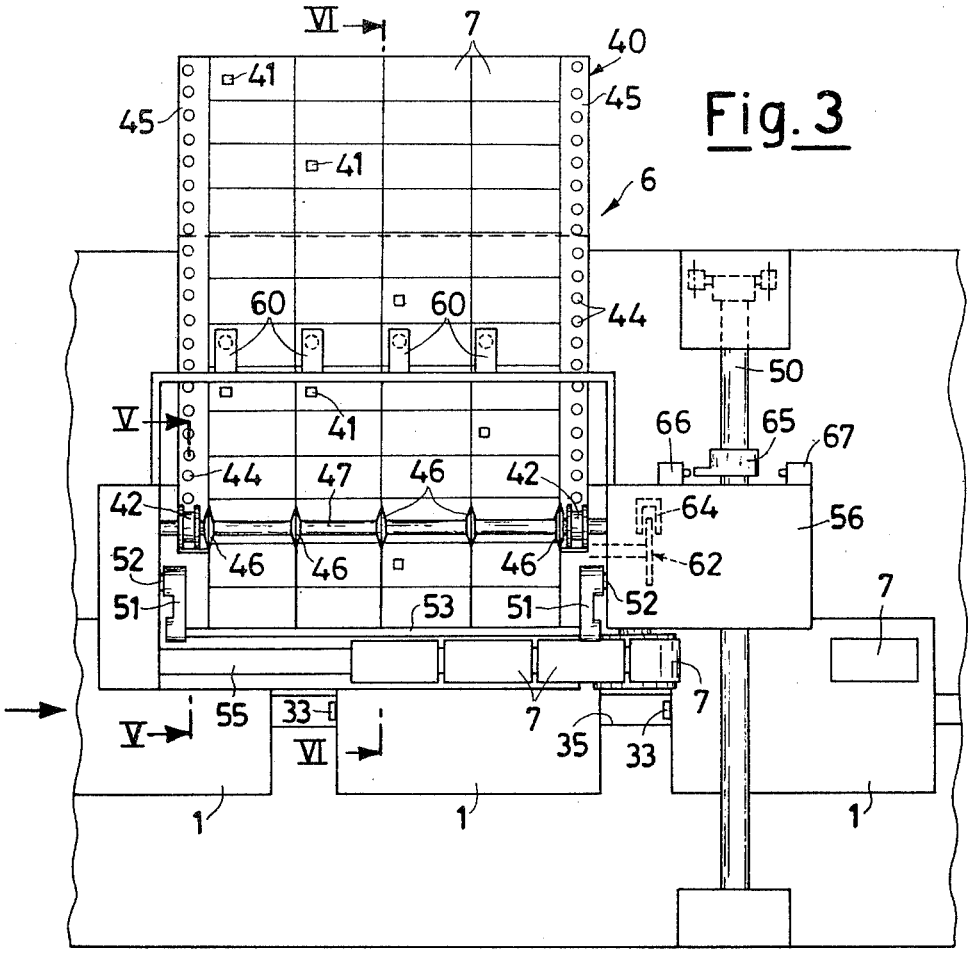
Fig. 3
Fig. 4
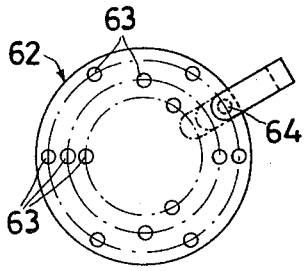

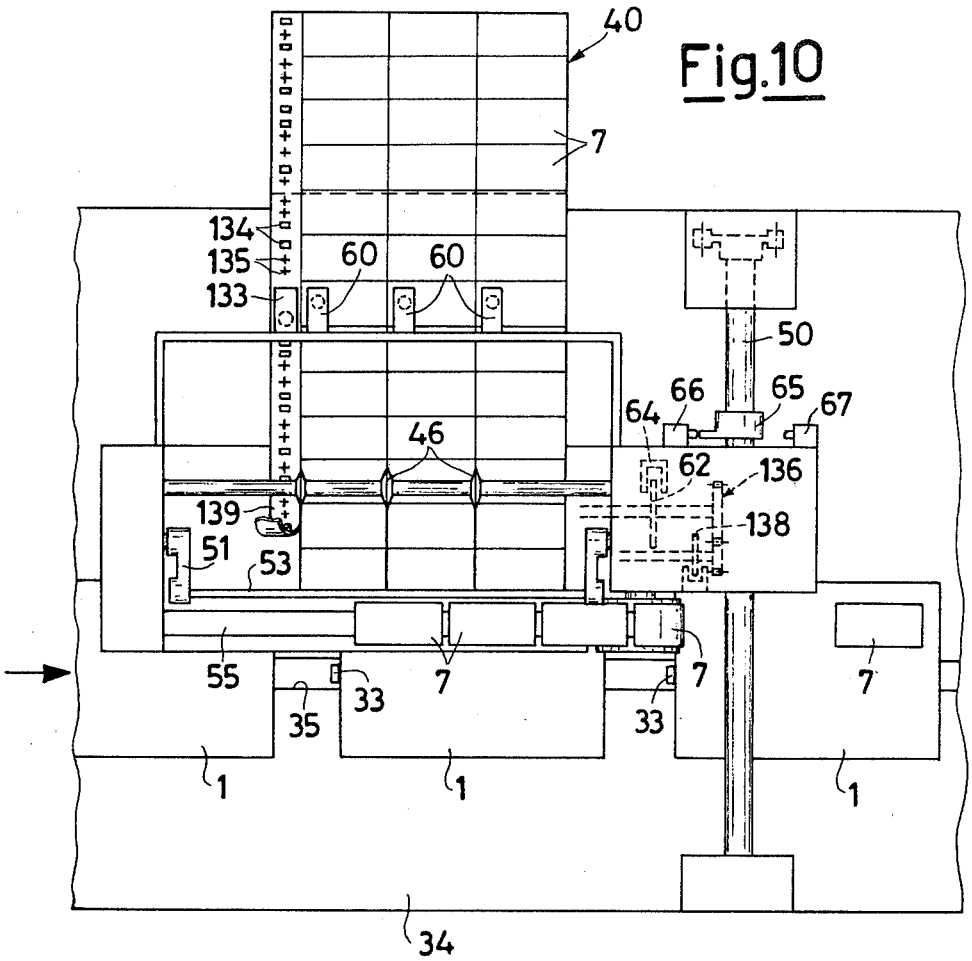
Fig.10
Fig.11
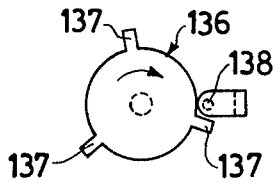

AUTOMATIC MACHINE FOR SORTING ITEMS OF CORRESPONDENCE, PARTICULARLY MAGAZINES, INTO BATCHES EACH HAVING A DIFFERENT GENERAL DESTINATION

The present invention relates to an automatic machine for sorting items of correspondence, in particular magazines, into batches each having a different general destination.

It is known to deliver to subscribers items such as magazines, either through the postal service or a carrier, after first providing them with a protective wrapping of polyethylene or the like that has, also internally, a label with the address and any other inserts of various kind.

The packaging of the items is usually performed with the aid of machines along which the items are advanced one after the other, then passing first through a label collocating station, then through a station for wrapping each item, with its label, in a film of polyethylene or the like, then through a station for the sealing and cutting of the film between one item and the next, and then on through a heating tunnel which causes shrinkage of the film so that it will adhere closely to the packaged item and, finally, to a stacking station where the items are grouped into batches each having a different general destination.

For the correct execution of this last operation, it is customary to make use of special identification marks, called final item marks, on some of the labels; these special final item identification marks indicate that the items with labels bearing them are the last of any series of items having the same general destination.

It is evident that a fully automatic machine using said marks must be able to read them at the most appropriate time, so as to stack the items in a corresponding manner into batches of different number and different general destination.

On the other hand, the reading of said marks on the labels already accompanying the respective items is neither easy nor sure inasmuch as the labels tend—having the same effect on the respective identification marks—to assume somewhat variable positions not conforming to the categorically fixed positions of the reading devices.

It is also difficult to imagine the possibility of reading the marks on the labels before these are collocated on the items and of feeding information regarding their presence or absence to the stacker in order to allow this to operate appropriately when the said articles, a little later, reach the stacker position, for the machine may be of variable velocity and provide for functions which do not permit an exact and invariable estimate of the time elapsing between the collocation of a label on an item and its arrival at the stacking position.

The purpose of the present invention is to solve this problem by embodying a machine such as fully automatically performs the sorting of the items into batches each having a different general destination, starting from the reading of the said marks pre-applied to address labels.

According to the invention this purpose is achieved by means of a machine comprising a station for the collocation of labels with and without said identification marks on the single items, a station for wrapping the items, with labels, in a film of heat-shrinkable plastics material, a station for sealing and cutting the film between one item and the next, a heating tunnel, a stacker and conveying means adapted to feed the items one after the other through said stations and as far as the said stacker, characterized by the fact that it comprises means for the reading of said identification marks, such means being in association with the label collocation station, so as to detect the presence or absence of said identification marks on said labels before the labels are collocated on the items, means for the feeding of recognition tabs, said means being positioned between said sealing and cutting station and said heating tunnel and commanded by said reading means to feed and apply a tab in a predetermined constant position on the film wrapping each item on which a label with said identification mark has previously been collocated, and means for detecting said tabs, these means being positioned between said heating tunnel and said stacker in order to detect the presence of said tabs on the items and consequently to command the stacker to terminate the formation of a batch of items with the top-stacking of the item, bearing the tab just detected.

In other words, the salient characteristic of the machine according to the invention is the fact that the reading of the identification marks, performed before the collocation of the labels on the items and thus when the said marks are still in an accurately pre-determinable position, is utilized only for the purpose of applying, immediately afterwards, recognition tabs in an exact and unchangeable position on the items which have received a label with identification mark. The constant time relation required is thus confined to that between the reading of the identification marks and the application of the tabs i.e. between two operations which can readily be carried out with a short interval between them and, in such interval, with the performance only of constant-velocity operations such as wrapping, sealing and cutting: in this way, the application of the tabs in a precise position on the items for which they are destined remain simple. The said tabs, no longer affected by problems of synchronization, can without difficulty be read by the detector means which precede the stacker and so permit the formation of correctly constituted batches having a different general destination.

It should be noted that it is not to be excluded that two labels with identification mark may follow each other at an over-short interval such as does not allow the formation of a batch made up of a number of items greater than a minimum (usually 5), said minimum being dictated by reasons of operability of the stacker. It is in such case preferably provided that on the item with label bearing the first of the two identification marks two tabs be applied instead of one, and that the detector means register this situation and so command the shunting of the items following the item with two tabs, up to the next article bearing a single tab.

Similarly, it may occur that the sealing and cutting of the film between one item and the next is not correctly executed, thus leaving the two items attached. To overcome such a difficulty provision is preferably made for means capable of detecting such condition and automatically commanding the shunting of the two attached items. If one of the shunted items bears a tab, provision is also made for the stacker to end the formation of the batch in progress.

These and other characteristics of the present invention will become evident from the following detailed description of some of its possible forms of practical embodiment, illustrated for reasons of non-limiting exemplification in the attached drawings, in which:

FIG. 1 is a perspective view showing schematically the fundamental parts and operations of a first example of machine according to the invention.

FIGS. 2*a* and 2*b*, to be seen as joined along the line X—X, are elevation views which show said machine in greater detail.

FIG. 3 is a top plan view of the label collocating station which forms part of the machine of FIG. 2.

FIG. 4 shows a detail of said collocating station.

FIG. 10 is a top plan view of the details of the label collocating station comprised in the machine of FIG. 9.

FIG. 11 illustrates a detail of the collocating station of FIG. 10.

Figure 1:
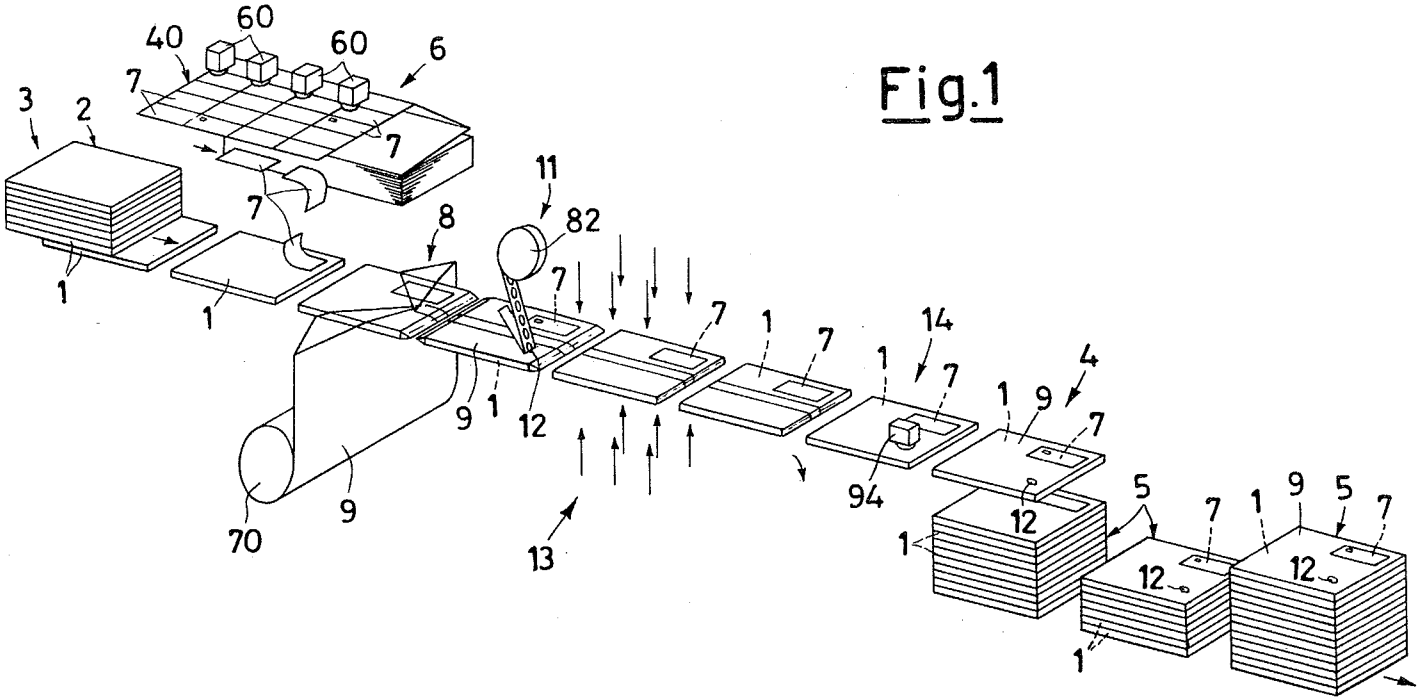

The FIGS. 1 to 8 consider an example of machine which provides that the items 1, for example magazines, are taken off one by one from a pile of items 2 stacked in a storage container 3 and fed in such condition to a stacker 4, which stacks them in batches 5 of different number and destination, the items then passing through a collocating station 6 for address labels 7, a station 8 for wrapping the items 1 in a film 9 of polyethylene or other heat-shrinkable material, a station 10 for sealing and cutting the film 9 between one item and the next (FIG. 2*a*), a station 11 for the application of metal recognition tabs 12, a heating tunnel 13 and a station 14 for detecting the tabs 12 and any items 1 that are attached one to the other.

Figures 2A, 2B:
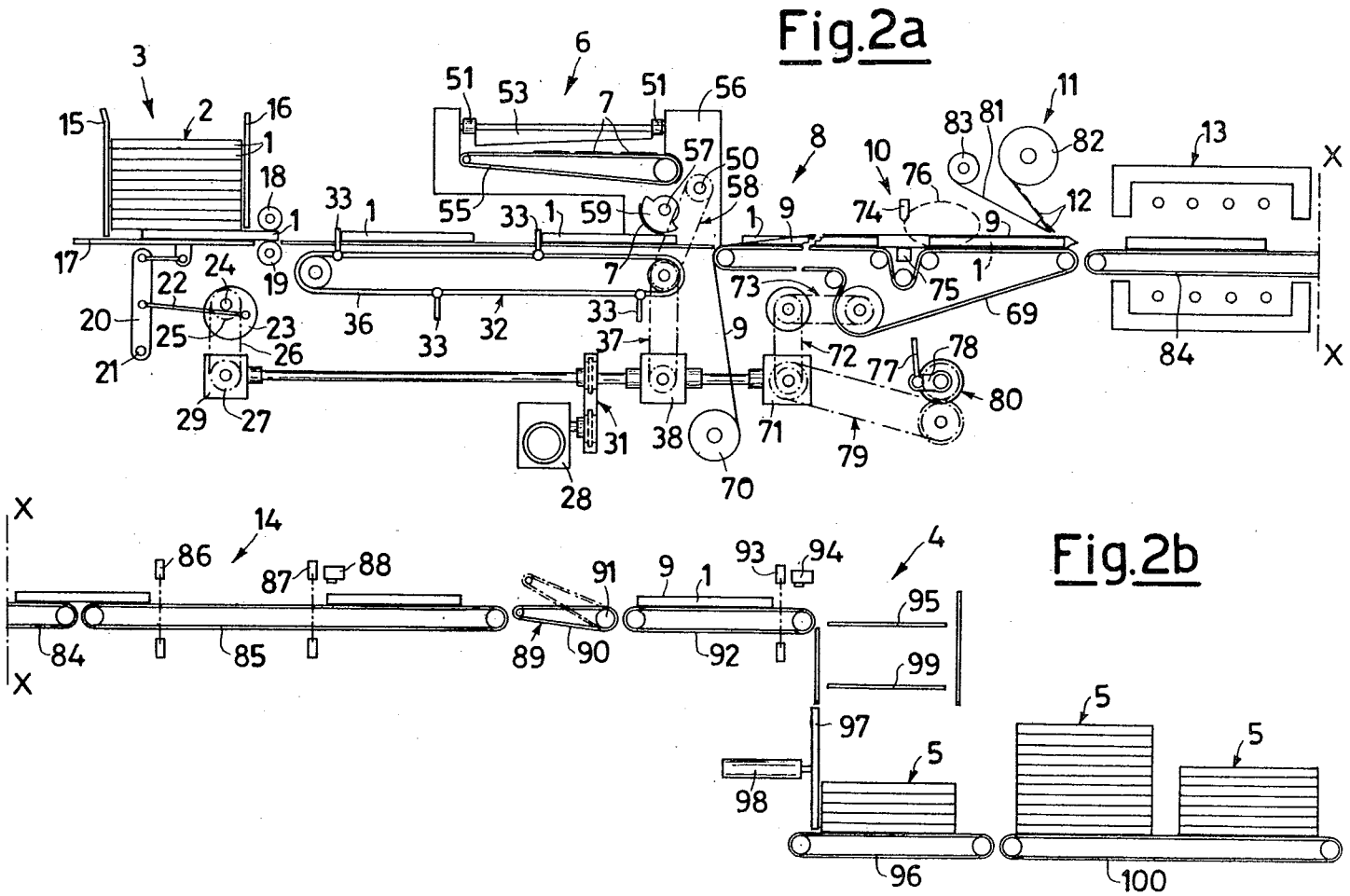

As illustrated in FIG. 2*a*, the storage container 3 provides for a pair of sides 15 and 16 and a baseplate 17 which is moved alternately to and fro to bring, one at a time, the various stacked items into engagement between a pair of feed rollers 18 and 19. The said to and fro movement is imparted to the plate 17 by a lever 20 fulcrumed at 21 and connected by a rod 22 to a wheel 23 rotatable about an eccentric axis 24 together with a pinion 25 connected by a chain 26 to a further pinion 27 in its turn connected to a motor 28 by means of a bevel gear pair 29, a transmission shaft 30 and a chain drive 31.

Downstream of the feed rollers 18 and 19 is a conveyor 32, which has a series of thrust pawls 33 emerging from a support surface 34 through a longitudinal window 35 (FIG. 3) and attached at regular intervals (FIG. 2*a*) to a belt 36 connected to the transmission shaft 30 through a chain drive 37 and a bevel gear pair 38.

Figure 5:
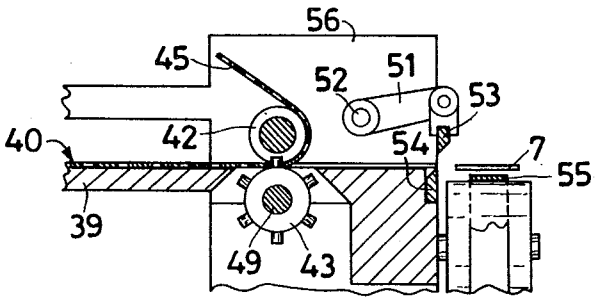
FIG. 5 shows another detail of said collocating station in section along the line V—V of FIG. 3.
Figure 6:
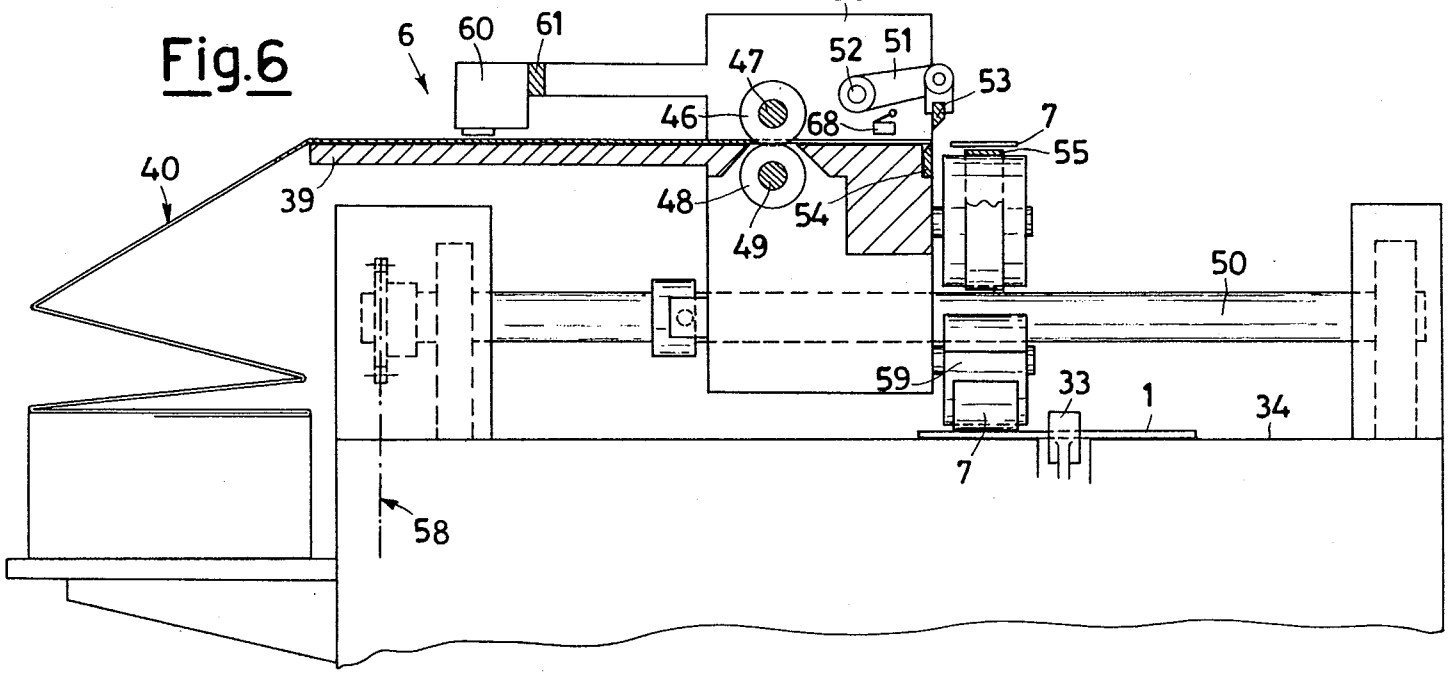
FIG. 6 shows said collocating station in section along the line VI—VI of FIG. 3.

The conveyor 32 advances the items 1, one after the other, through the label collocating station 6, which, as illustrated in FIGS. 2*a* and 3–6, has, solidly with a support 56, a fixed horizontal surface 39 intended for the support and advancement of a tabulation 40 formed (in this case) of four side-by-side solidly joined rows of address labels 7, some of which bear final item identification marks 41 in a fixed position with respect to the edges of the labels so as to be readable for the respective reading devices 60 supported by a common bar 61 secured to the support 56 (FIGS. 3 and 6). The advancement of the tabulation 40 is caused, in cooperation with two pressor wheels 42 (FIGS. 3 and 5), by two driving sprockets 43 (FIG. 5) adapted to engage aligned holes 44 in two lateral strips 45 of the tabulation, these being used for shunting (FIG. 5) towards wrapper rollers not illustrated in the drawings. To allow the said shunting of the strips 45 and similarly to allow the separation of the four rows of labels, there are, coaxially with the pressor wheels 42, five cutting-edge wheels 46 fitted onto an idle shaft 47 and cooperating with the underlying wheels 48 (FIG. 6) which are in turn fitted onto a common shaft 49 which also bears the sprockets 43 and operationally connected, in a manner not illustrated in the drawings, to a drive shaft 50 (FIGS. 3 and 6). To this drive shaft, connected to the conveyor 32 by a chain transmission 58 (FIG. 2*a*), there is also operationally connected a pair of arms 51, rotatable at 52, which carry a cutting blade 53 cooperating with a static blade 54 (FIGS. 3, 6 and 5). In both cases the speed ratio, which varies with the width of the labels 7, is such that at every rotation of the drive shaft 50 the tabulation 40 advances to an extent corresponding to the width of a label 7 and the blade 53 meets the static blade 54 below to separate from the tabulation 54 the first set of four side-by-side labels, such set being already fed onto a delivery belt 55 (FIGS. 2*a*, 3, 5 and 6). At the output of this latter there is continuously rotatable at 57 (FIG. 2*a*) a half-wheel 59, which takes off one at a time the cut labels from the delivery belt 55 and collocates them on an underlying item 1 advanced by the conveyor 32. To the drive shaft 50 there is also operationally connected, with a fixed speed ratio, a wheel 62 with three successive sets of three, four and six holes 63 on its circumference, with one or another of which there is selectively called upon to cooperate in relation to the width (which varies with the same numerical ratio as the aforesaid holes) of the labels 7, a photocell sensor 64 (FIG. 4). Finally, a cam 65 is rigidly fixed to the drive shaft 50 to actuate at different instants two microswitches 66 and 67 (FIG. 3); a third microswitch 68, on the other hand, is actuated by one of the rotatable arms 51 when the blade 53 is lowered to cut the block 40.

The wrapping station 8 is positioned at the exit of the label collocating station 6 (FIGS. 1 and 2*a*) and substantially consists of a conveyor belt 69 onto which is fed by a roller 70 the film 9, which appropriate shaped guides in se known and not illustrated in the drawings fold over the items 1 and the related labels 7.

The conveyor belt 69 receives its movement from the transmission shaft 30 through a bevel gear pair 71 and two chain transmissions 72 and 73, and also acts as conveyor for the items 1 wrapped in the film 9 through the successive sealing and cutting station 10, which in turn comprises in a manner in se known a sealing and cutting blade 74 and a static blade 75, said blade 74 being moved through an elliptical trajectory 76 (FIG. 2*a*) under the control of a rod 77 secured to a crank 78 in its turn moved by the transmission shaft 30 through the bevel gear pair 71, a chain transmission 79 and a geared coupling 80. An example of sealing and cutting station of this type is illustrated in U.S. Pat. No. 3,758,366.

The said conveyor belt 69 also feeds the items 1 with wraps of film 9 closed around them and around the related labels 7 to the subsequent station 11, where the metal tabs 12 are separated, when appropriate, by a support belt 81 unwinding from an idle roller 82 to a motor-driven roller 83 and adhered onto the film wrapper 9 of the items 1 to which they are destined. The actuation of the roller 83 is subordinate to the reading made by the readers 60 at the label collating station 6, in the sense that a metal tab 12 is applied to each item 1 bearing a label 7 with identification mark 61 previously read by a reader 60.

Figure 7:
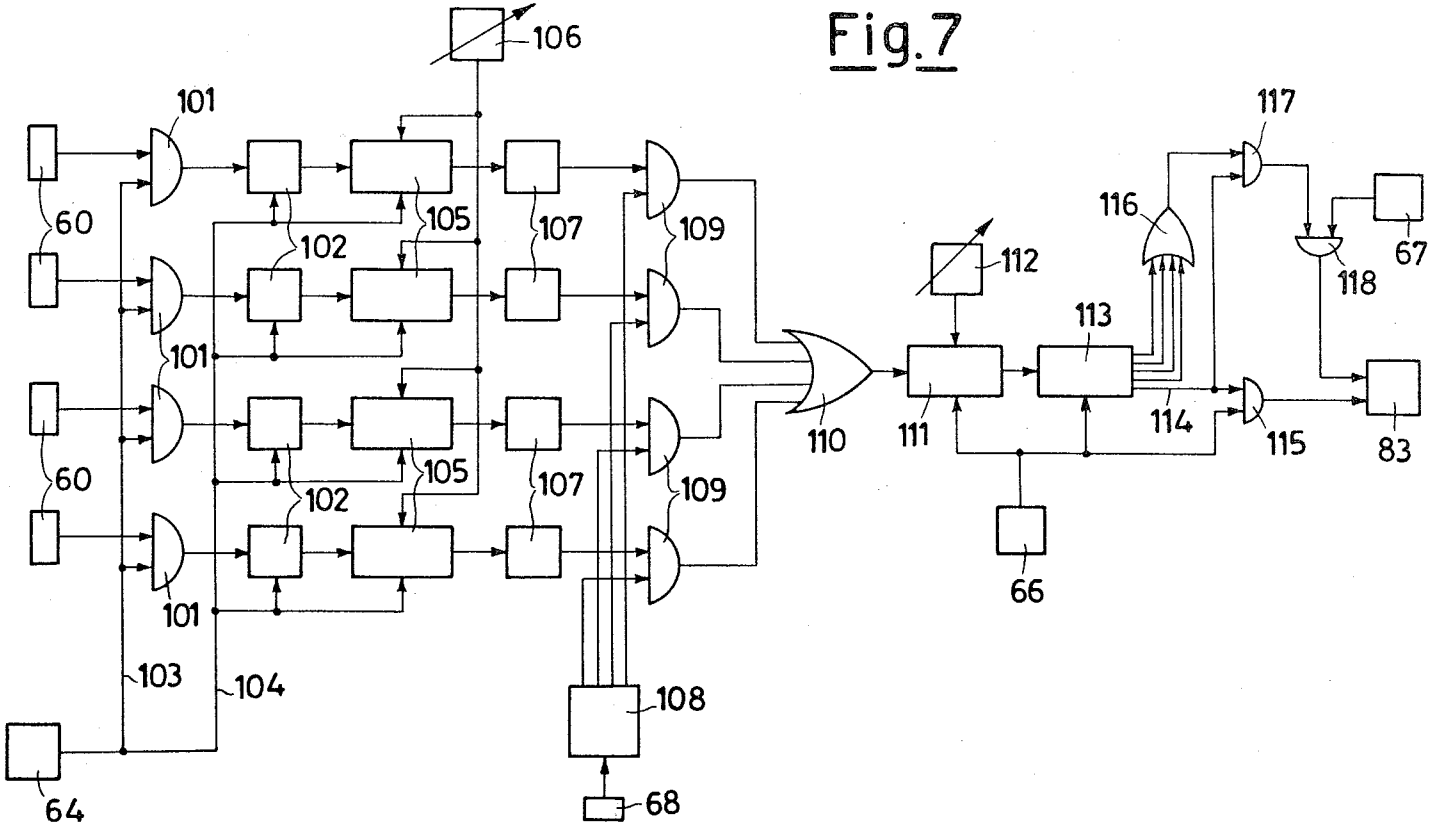
FIG. 7 is a block diagram of an electronic control unit which operationally connects the final item identification mark reading means to the recognition tab feeding means in the machine of FIG. 2.

In order to obtain the correct synchronism between reading of the identification marks 41 and application of the metal tabs 12, provision is made for the control unit of FIG. 7, the structure of which will be described later herein in connection with the manner of functioning of the machine of FIGS. 1–8.

At the delivery exit of the conveyor belt 69 there is positioned another conveyor belt 84 which goes through the heating tunnel 13 (FIG. 2*a*) and is in turn followed by another conveyor belt 85 (FIG. 2*b*), along which are positioned two pairs of photocells 86 and 87 (at a distance greater than the length of item 1 but less than double the length of said item), followed by a proximity sensor 88 capable of detecting the passage of the metal tabs 12 applied to the wrappers of some of the items 1. At the outlet end of the conveyor belt 85 is positioned a shunting device 89 consisting of a belt 90 rotatable at will around the axis of the roller 91, and then another conveyor belt 92, close to the outlet of which are a pair of photocells 93 and a proximity sensor 94 having the same characteristics and capacity as the sensor 88.

The whole constitutes the station for detecting the metal tabs 12.

Finally, at the outlet end of the conveyor 92 is the stacker 4, which is of a type described in a copending Italian patent application No. 22143 A/79 filed on Apr. 24, 1979 and substantially comprising a pair of upper blades 95 alternately commanded to close and open in order first to receive and then to drop the single items 1, an underlying collecting and stacking belt 96, an expulsion blade 97 controlled by a pneumatic cylinder 98 and a pair of lower blades 99 commanded to close momentarily during the expulsion step of the batches 5 from the collecting belt 96 to a successive outlet belt 100. The various elements of the detecting station 14 and of the stacker 4 are operationally interconnected by the control unit of FIG. 8, which will subsequently be described in connection with the manner of operating of the entire machine.

The operating cycle of the machine of the FIGS. 1–8 starts, as illustrated in FIGS. 1 and 2*a*, with the delivery of one item at a time by the baseplate 17 of the storage container 3. The items are received on the conveyor 32 and fed to the label collocating station 6 with constant reciprocal spacing determined by the distance between the thrust pawls 33 and also at constant velocity set by the motor 28 and by the various transmission means thereto connected.

In the label collocating station 6 (FIGS. 2*a* and 3–6), the sprocket wheels 43 cause the tabulation 40 to advance at constant speed, while the cutting blade 53 periodically separates from the said tabulation the first set of labels 7, already separated one from the other by the cut made by the cutting-edge wheels 46. Said separated labels are then collocated one by one on respective items 1 by the half-wheel 59, which in its turn receives them in succession from the outlet conveyor 55. The items with labels collocated on them are then wrapped in the film 9 which is cut and sealed between one item and the next by the cooperating blades 74 and 75 and also sealed along the longitudinal seal line by known means not illustrated in the drawings. Before they enter the heating tunnel 13, the wrappers of some of the items 1 have applied to them one or two metal tabs 12 in the manner explained below in connection with the constitution of the control unit of FIG. 7.

As previously stated, some labels 7 of the tabulation 40 bear identification marks 41 which indicate that the related labels are destined for articles each constituting the last item of one and the same batch having a single general destination. Each time a set of four labels 7 passes under the four readers 60 these read the presence or absence of identification marks 41 on said labels and, coincident with a clock or phasing signal 103 periodically supplied by the photocell sensor 64 (FIG. 4) to enabling inputs of four AND logical gates 101 they concomitantly transmit presence signals (from now on called "1") or absence signals (from now on called "0") to respective memories 102. The phasing signals 103 are omitted by the sensor 64 each time it detects the passage of one of the holes 63 of the wheel 62, the sensor 64 being selectively positioned so as to sense one or another of the three sets of holes 63 depending on the width of the labels 7. In effect, the innermost set will be selected for a maximum label width, the intermediate set for an intermediate width and the outermost set for a minimum label width, so as to have more frequent phasing signals according as the label width is less, and thus so much higher is the frequency of possible readings of identification marks 41 by the readers 60.

While a phasing signal 103 is emitted by the sensor 64 each time it senses a hole 63, a further signal 104 is emitted by the same sensor 64 each time it abandons the said hole 63. Said signal 104 acts as a clock for the memories 102 and for the successive programmable shift registers 105, so as to allow the transfer of the memorized signals "1" or "0" from the former to the latter.

The programmable registers 105 are pre-set by a programmer 106 in a condition, which varies with the width of the labels 7, such that each signal "1" coming from the related reader 60 to indicate the presence of an identification mark 41 will arrive at the output of the related register 105 after a very precise number of clock signals, which number is pre-set in a manner such as to allow the set of labels 7 in which the aforesaid identification mark 41 was read to be located, in synchronism, on the outlet conveyor 55. At that point the situation at the output of the registers 105 is memorized in parallel by respective memories 107 and by means of AND gates 109 explored in succession, and thus serialized in the same way as the labels leaving the collocating station 6 (FIGS. 2*a* and 3) are serialized, by a counter 108 immediately in precedence zeroed by the microswitch 68 as a result of the actuating of this by the arms 51 which support the cutting blade 53. A successive OR gate 110 then places in series on a single output the four signals explored in succession by the counter 108.

The situation read by the readers 60 on a determined set of four labels 7 (and what is now stated clearly applies to all the sets of labels read subsequently and previously) thus appears at the output of the OR gate 110 in the form of four signals in series ("1" or "0") which follow each other in synchronism with the collocating of the said labels read on the related items 1. Said signals and, subsequently, at a constant rate fixed by the clock of the photocell sensor 64, the signals relating to the successive sets of four labels, reach the input of a further programmable register 111 which, through a programmer 112, has been pre-set, in relation to the distance between the station 6 for collocating the labels 7 and the station 11 for the application of the metal tabs 12 so that each of said signals reaches the output of the register 111 after a number of clock signals, supplied by the microswitch 66 (FIG. 3), equal to the difference between the number of items 1 positioned between the stations 6 and 11 and a minimum number of articles with which it is wished to make up the batches 5, said minimum number also representing the minimum acceptable distance between the stations 6 and 11. Consequently, if the distance between the two stations exactly corresponds to said minimum number (or for example 5, as from now on considered for the sake of simplicity and clarity of description), a signal "1" at the output of the OR gate 110, synchronized as has been stated with a label bearing an identification mark 41 just placed on the related item 1, immediately reaches the output of the programmable register 111 and the input of a successive fixed register 113 having five shift positions and five outputs (the said minimum number remaining five), said register also being controlled by the microswitch 66, while if the distance is greater, for example 8, the said signal "1" reaches the output of the programmable register 111 and the input of the fixed register 113 after a number of clock signals equal to the difference between 8 and 5, in other words after three clock signals. Since the fixed register 113 is so constructed that to each signal "1" at its input there corresponds a like signal "1" at a preselected one (114) of five register outputs after five clock signals it is evident that the aforesaid programming of the register 111 causes each signal "1" at the output of the OR gate 110 in any case to reach the output 114 of the register 113 after a number of clocks equal to the distance between the stations 6 and 11, it thus becoming possible to determine through an AND gate 115 the actuation of the roller 83 for the application of a metal tab 12 exactly synchronized with the arrival at the station 11 of the item 1 on which has been collocated the label 7 bearing the identification mark 41 earlier read by one of the readers 60. In this way there is achieved the requisite perfect correspondence between the reading of an identification mark 41 and the application of a metal tab 12.

Everything proceeds as stated if each identification mark 41 is spaced from the previous one by a number of labels 7 at least equal to the aforesaid minimum number, i.e. 5. If this is not so, as for example in the case of the two identification marks present in the group of labels which in FIG. 3 are illustrated as just read by the readers 60 (what is involved, that is to say, is the sixth group of labels starting from the cutting blade 53), when the signal "1" corresponding to the first of the two identification marks reaches the output 114 of the register 113 to cause the application of a metal tab 12 on the corresponding item 1, a second signal "1" correponding to the second identification mark 41 is present on one of the other four outputs of the same register 114 and, through a OR gate 116 and two gates AND 117 and 118 controlled respectively by the output 114 of the register 113 and by the microswitch 67, causes a second actuation (retarded with respect to the first by reason of the phase difference between the microswitches 66 and 67) of the roller 83 for the application of a second metal tab 12 on the same item 1 which has already received the first. The presence of two metal tabs 12 on one and the same item will thus be indicative of the fact that the next item with a metal tab will follow at a distance smaller than the minimum number of items considered acceptable for each batch 5.

The items already labelled and wrapped at the outlet of the station 11 and then at the outlet of the heating tunnel 13, where the film 9 has been caused to shrink through the effect of heat until it clings closely to the outside of the item, are therefore without metal tabs if it is a question of any one of the items of a series of articles having the same general destination, with one metal tab 12 only if it is a question of the final item of a series of items having the same general destination, which is followed by a similar series of items numerically greater than the minimum number acceptable for the formation of a batch 5, and finally with two metal tabs 12 if it is a question of the final item of a series of items of the same general destination which is followed by a similar series of items numerically inferior to said minimum acceptable number.

Figure 8:
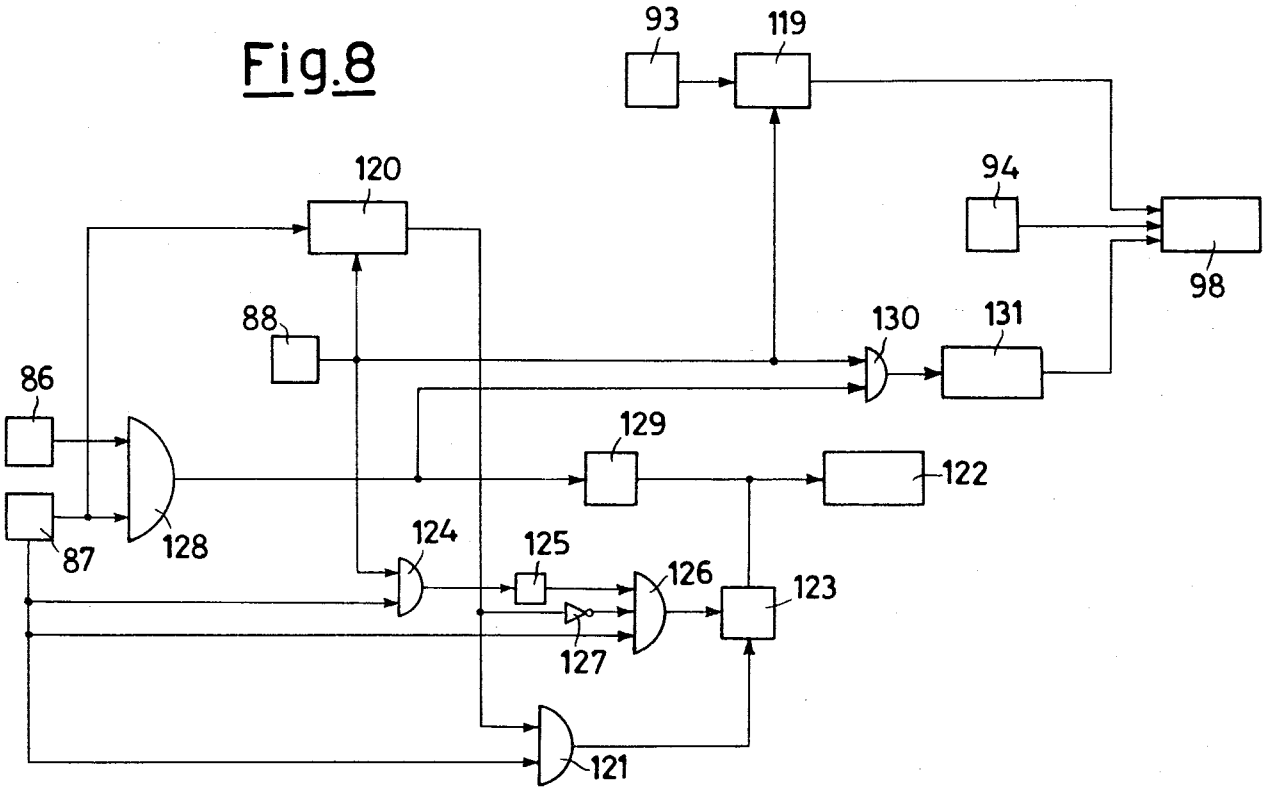
FIG. 8 is a block diagram of an electronic control unit which operationally connects the tab detector means, and also the means for detecting any attached items, to the stacker and to a shunting device in the machine of FIG. 2.

The different situation of the various items are detected by the various sensitive members of the detecting station 14, which, through the control unit of FIG. 8, cause corresponding operational actions of the stacker 4 and shunter 89. More exactly, the arrival of a series of items without metal tab simply causes, through the pair of photocells 93, the progressive updating of a digital counter 119, which periodically commands the cylinder 98 of the stacker 4 to expel a batch of items in a pre-set number, for example thirty items. When, after the said series, an item with a single metal tab is sensed by the proximity sensor 88, this sensor blocks and zeroes the counter 119 so as to allow the next proximity sensor 94 to cause the expulsion of the batch being formed, immediately after the said item with metal tab has joined those already stacked to round off the said batch. If the aforesaid series is, on the other hand, terminated by an item bearing two metal tabs, in addition to the zeroing of the counter 119 and the operational action of the expulsion cylinder 98, a counter 120, enabled by the previous passage of the item through the pair of photocells 87, counts the two detections of the proximity sensor 88 and, when the following article (with or without metal tab) is sensed by the pair of photocells 97, commands, through a logical AND gate 121 and a memory 123, the actuation of a control member 122 of the shunter 89 for the shifting of the latter to the position illustrated by dashes and dots in FIG. 2*b*. Said following item is thus discharged together with all the other items which follow it up to the arrival of the next item with one or two metal tabs; in the first instance the combination of detection signals of the pair of photocells 87 and of the proximity sensor 88 at the inputs of a logical AND gate 124 sets up at the output of this latter a logical condition which, through a delay line 125, combines at the input of another logical AND gate 126 with the successive signal coming from the pair of photocells 87 to clear the memory 123 and thus bring the shunter 89 into the position indicated by the continuous line in FIG. 2*b* at the time of arrival of the item following the item with a metal tab; in the second instance, on the other hand, nothing changes on account of the intervention of the counter through an inverter 127.

It may also occur that there arrive at the detection station 14 two attached items resulting from an incorrectly performed sealing and cutting operation. In such case the two pairs of photocells 86 and 87 are simultaneously crossed and obscured by the two attached items, so that at the output of a logical AND gate 128 a signal is present which, through a memory 129, shifts the shunter 89 to an off-load position. This situation, which causes the removal of the two (or more) attached items, lasts until the time when there is no longer coincidence between the photocells 86 and 87. It may happen that one of the articles off-loaded bore one or two metal tabs: in the first instance the sensor 88 senses the tab and, as the photocells 86 and 87 are at the same time obscured, commands through a logical AND gate 130 and a delay line 131 the actuation of the expeller cylinder 97 with a sufficient time lag to cause the final item preceding the attached items also to fall onto the batch being formed; in the second instance, in addition, the shunter 89 is maintained at the off-load position until such time as there is another item with a single metal tab.

In this way, after the identification by means of one or two metal tabs of the final items of each series of items having the same general destination followed by a similar series with items respectively numerically greater and smaller than a pre-set minimum number, it becomes possible to sort the items into batches having different general destination, discarding both the series of items numerically inferior to the acceptable minimum and any items remaining attached together.

Figure 9:
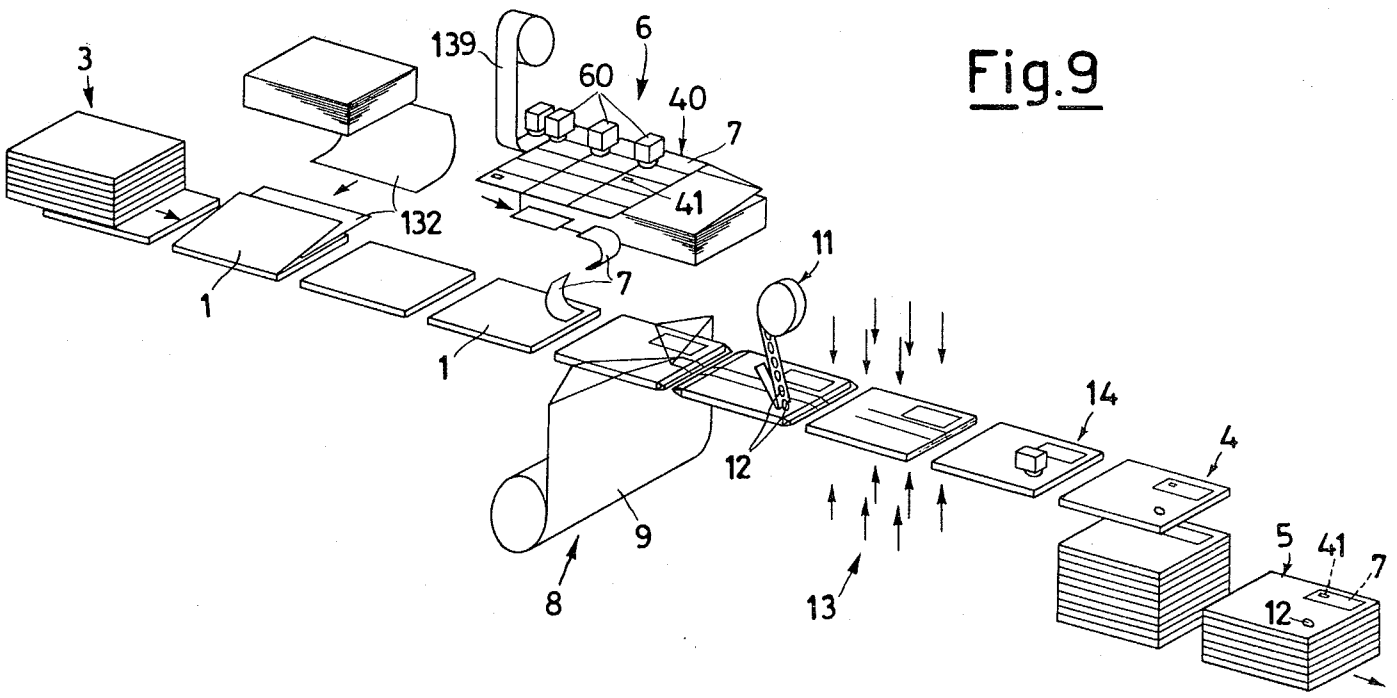
FIG. 9 is a perspective view schematically illustrating the fundamental parts and operations of a second example of machine according to the invention.

The FIGS. 9, 10 and 11 illustrate a variant of the machine of FIGS. 1–8 which provides for the preventive association of additional inserts 132, such as order notes, subscription renewal sheets and so on, with some of the items 1. The selection of these latter is handled by the station 6 for the collocation of the labels 7, where a further reader 133 is enabled to read in a lateral removable strip 139 identification marks 134 indicating the request for insertion or identification marks 135 indicating the contrary request, each mark being paired with a respective label of each set of three labels 7.

The rate of reading of the identification marks 134 and 135 is set by a further wheel 136 provided with three radial protruberances 137 with which an electromagnetic sensor 138 cooperates.

Figure 12:
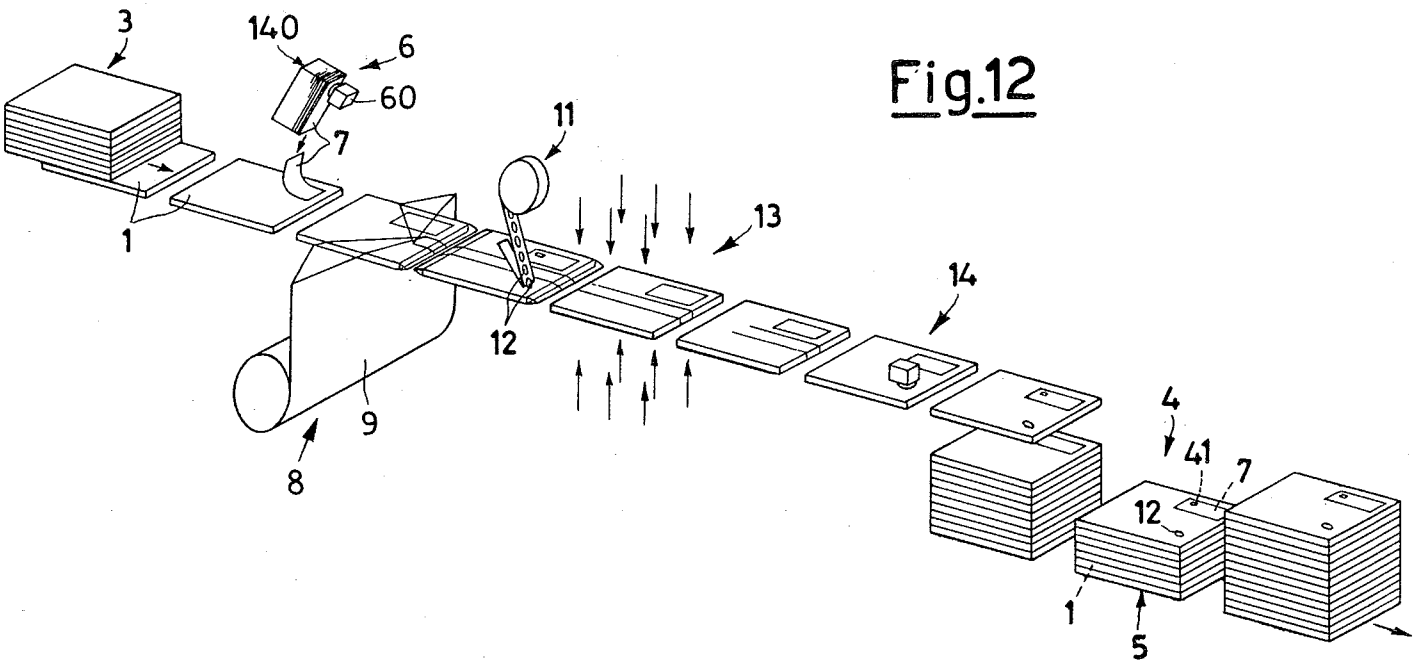
FIGS. 12 and 13 are perspective views showing schematically the fundamental parts and operations of two further examples of machines according to the invention.
Figure 13:
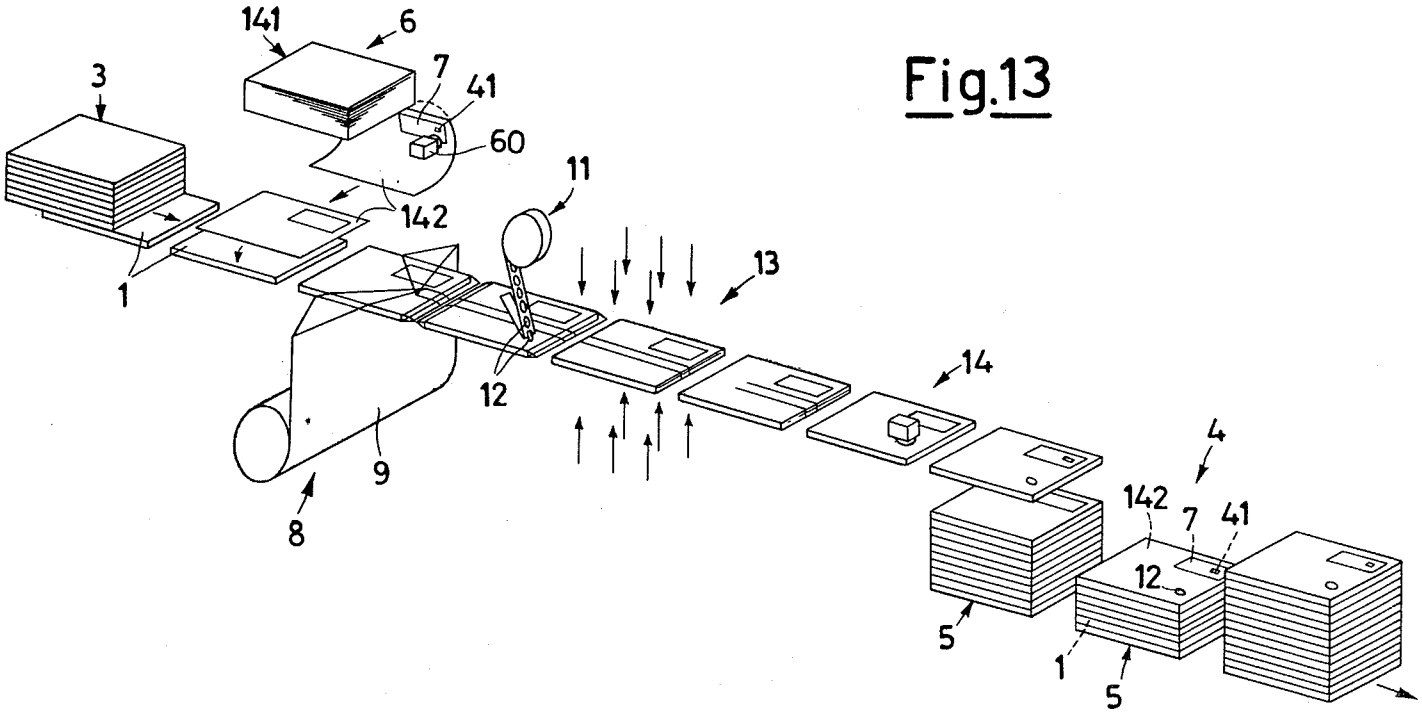

Finally, the FIGS. 12 and 13 illustrate further variants in which, respectively, the labels 7 with identification marks 41 are taken off directly from a single pack of labels 140 and then read one by one by a single reader 60, or the labels 7 are already associated with inserts 142 taken off one at a time from a pack 141 and caused to pass before a single reader 60 of the identification marks 41 of the labels 7.

We claim:

1. An automatic machine for the sorting of items of correspondence, particularly magazines, into batches of different general destination, comprising a station for the collocation of labels, some of which bearing a final item identification mark, on the individual items, a station for the wrapping of the items plus labels in a film of heat-shrinkable plastics material, a station for sealing and cutting the film between one item and the next, a heating tunnel, a stacker, and conveying means adapted to feed the items one after the other through said stations and as far as the said stacker, characterized in that the machine comprises means for the reading of said identification marks, in association with said label collocating station, so as to detect the presence or absence of said identification marks on said labels before the collocation of the latter on the single items, feeding means for recognition tabs which means are positioned between said sealing and cutting station and said heating tunnel and commanded by said sealing means to feed a tab in a constant pre-set position on the film which wraps each item onto which there has previously been collocated a label bearing an identification mark and means for detecting said tabs, such means being positioned between said heating tunnel and said stacker to detect the presence of said tabs on the related items and consequently to command the stacker to terminate the formation of a batch of articles with the top-stacking of the item with tab just detected.

2. A machine according to claim 1, characterized in that said label collocating station includes means for feeding a tabulation consisting of sets of labels in succession in side-by-side position and cutting means able to separate the labels of each set from each other and from the following set to allow their feeding in series to the items for which they are destined, said identification mark reading means including a reader for each label of each set and being operationally connected to said tab feeding means through a control unit including means for transferring in parallel signals of presence or absence of identification marks on each set of labels, said signals being originated by said readers in synchronization with the advancement of said set of labels beyond said cutting means, means for the serialization and transmission in series of said signals in synchronization with the feeding in series of the labels of said set to the related items and means for applying said signals to said tab feeding means in synchronization with the arrival of the items that have received said labels at said tab feeding means.

3. A machine according to claim 2, characterized in that said in-parallel transfer means comprise a programmable shift register for each reader, said register being programmed in relation to the width of the labels.

4. A machine according to claim 3, characterized in that said serialization and series transmission means comprise means for the cyclic exploration of the outputs of said registers.

5. A machine according to claim 3, characterized in that said signal application means comprise a further programmable register and a fixed register, said further programmable register being programmed for a number of shifts equal to the difference between the number of items between said label collocating and tab feeding stations and a minimum number of items desired for each of said batches, and said fixed register having a number of shifts and a number of outputs equal to said minimum number and having as output for applying signals to said tab feeding means that which is attainable by an input signal at the end of said number of shifts.

6. A machine according to claim 5, characterized in that the machine comprises means sensitive to the state of the other outputs of said fixed register, which command the consecutive application of a second tab on the same article in the event that an output signal on said application output is accompanied by a simultaneous signal on one of the other outputs, thus indicating the presence of identification marks on labels associated with items with a space between them that is less than the said minimum number.

7. A machine according to claim 1, characterized in that said stacker includes an item counter adapted to command the termination of the stacking and the expulsion of the already formed batch of items at each pre-set number of items received, a first tab sensor adapted to interrupt and zero the counting of said counter in the event of detection of at least one tab on the article arriving, a second tab sensor positioned downstream of the first and adapted to command the expulsion of the batch of items under formation immediately after the stacking of an item with at least one tab detected by said second sensor, and a tab counter associated with said first sensor to command the shifting of a shunter positioned between said sensors to a position for off-loading the items coincidentally with the arrival of the following item bearing one or two tabs and until the arrival of the item which follows a successive item with a tab on it.

8. A machine according to claim 7, characterized in that the machine comprises photocell means adapted to sense any arrival of items which are attached together and consequently to command the shifting of said shunter to off-load position until the arrival of a successive nonattached item, provision being made for means associated with said first sensor, with said tab counter and with said photocell means for commanding the expulsion of the batch of items in the stacker if one of the discarded items bears at least one tab.

9. A machine according to claim 1, characterized in that with said block is associated a lateral strip bearing a further identification mark for each label of each set of adjacent labels, said further identification mark indicating that there is required or not required the preventive addition of an insert for the item for which is destined the label associated with said identification mark and provision being made in the label collocating station for a further reader adapted to detect said identification mark and consequently to command the feeding or not feeding of said insert upstream of said label collocating station.

10. A machine according to claim 1, characterized in that said label collocating station provides for a single identification mark reader, at which said labels are fed one at a time.

11. A machine according claim 10, characterized in that each label is pre-associated with a respective insert to be added to the related article.

* * * * *

UNITED STATES PATENT AND TRADEMARK OFFICE

CERTIFICATE OF CORRECTION

PATENT NO. : 4,338,768

DATED : July 13, 1982

INVENTOR(S) : Aris Ballestrazzi and Lamberto Tassi

It is certified that error appears in the above—identified patent and that said Letters Patent is hereby corrected as shown below:

Claim 1, line 19, "sealing" should read --reading--.

Signed and Sealed this

*Twelfth* Day of *July 1983*

[SEAL]

*Attest:*

GERALD J. MOSSINGHOFF

*Attesting Officer*

*Commissioner of Patents and Trademarks*